US005758801A

United States Patent [19]

Roling et al.

[11] Patent Number: 5,758,801

[45] Date of Patent: Jun. 2, 1998

[54] DISPENSER FOR FREE-FLOWING, FINE GRANULAR, POWDERED OR BEADED SUBSTANCES

[76] Inventors: Markus Roling; Volker Zitzmann, both of Am Salzstadel 5, 83022 Rosenheim, Germany

[21] Appl. No.: 702,182

[22] Filed: Aug. 23, 1996

[30] Foreign Application Priority Data

Feb. 22, 1996 [DE] Germany ..... 296 03 108.9

[51] Int. Cl.[6] ..... A47G 19/24

[52] U.S. Cl. ..... 222/129; 222/142.1; 222/206; 222/212; 222/511

[58] Field of Search ..... 222/129, 23, 206, 222/215, 142.1, 142.2, 142.4, 142.6, 142.7, 175, 481, 511, 512, 515, 517, 544, 565, 212; 267/170, 166, 167

[56] References Cited

U.S. PATENT DOCUMENTS

| | | | |
|---|---|---|---|
| 1,561,119 | 11/1925 | Smith | 267/170 X |
| 1,628,106 | 5/1927 | Booty | 222/129 X |
| 1,816,141 | 7/1931 | Booty | 222/501 |
| 2,882,547 | 4/1959 | Bacon | 267/170 X |
| 3,485,416 | 12/1969 | Fohrman | 222/142.1 |
| 3,964,642 | 6/1976 | Lesh et al. | 222/142.4 |
| 4,387,809 | 6/1983 | Botzler | 222/129 X |
| 4,598,844 | 7/1986 | Morris | 222/565 X |

FOREIGN PATENT DOCUMENTS

| | | | |
|---|---|---|---|
| 1061596 | 4/1954 | France | 222/142.1 |

*Primary Examiner*—Kevin P. Shaver
*Attorney, Agent, or Firm*—McGlew and Tuttle

[57] ABSTRACT

A dispenser for free-flowing substances, fine granular substances, powdered substances or beaded substances where a radial surface of the container is formed by a coil spring with a plurality of turns. The plurality of turns are positioned to be in contact with each other and the coil spring has a biasing force which presses the plurality of turns against each other. The position and biasing force of the coil spring are such to block the passing of the substance from inside the coil spring, through the plurality of turns, and towards the outside of the coil spring. Closing devices are fitted into the ends of the coil spring to prevent the substance inside the coil spring from moving out of the coil spring through the axial ends of the coil spring. The closing devices are preferably designed to be repetitively attachable and detachable without significant damage to the spring or the closing device.

17 Claims, 2 Drawing Sheets

DISPENSER FOR FREE-FLOWING, FINE GRANULAR, POWDERED OR BEADED SUBSTANCES

FIELD OF THE INVENTION

The present invention is a dispense for free-flowing, fine granular, powdered or beaded substances, and in particular substances such as spices, sugar and sugar substitutes, and various powders.

BACKGROUND OF THE INVENTION

The extensive travel activity, which is widespread in our time, leads to increasing numbers of persons taking with them objects of personal need, whose ready availability is considered to be particularly important. Accommodation and, last but not least, securing against leakage, especially slow leakage by the substance trickling out, are a considerable problem in the handling of free-flowing substances, e.g., especially spices, sugar substitutes or cosmetics occurring in the powdered, granular or fine beaded form.

SUMMARY AND OBJECTS OF THE INVENTION

The object of the present invention is to provide a compact dispenser for such free-flowing materials, which is easy to carry and can be handled without problems.

The object of the present invention is accomplished by a draw or coil spring having a plurality of turns. The plurality of turns are positioned to be in contact with each other and the coil spring has a bias which forces the plurality of turns against each other. The plurality of turns thus define a chamber inside the coil spring and this chamber is used to hold the substances. The plurality of turns are positioned in contact with each other and with such a biasing force, to block passage of the substance from passing from the chamber through the turns and to the outside of the coil spring when the coil spring is in a substantially straight or equilibrium state. The plurality of turns and the biasing force is of such a magnitude so that the coil spring can be bent by the hands of an operator to separate the plurality of turns by a large enough amount for passage of the substance in the chamber to flow through the turns and to the outside of the coil spring.

First and second enclosure means are provided which fit into the axial ends of the coil spring and block passage of the substance out of the chamber through the axial ends of the coil spring. At least one of the enclosure means is designed to be repetitively attachable and detachable from the axial end of the coil spring without significant damage to the closure means.

A partition can be placed inside the coil spring to divide the chamber into first and second chambers. In such an embodiment each of the first and second closure means are preferably designed to be repetitively attachable and detachable from the axial end of the coil spring.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
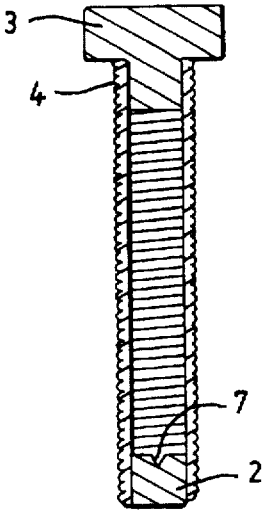
FIG. 1 is a sectional view of a one-part dispenser according to the present invention.
Figure 2:
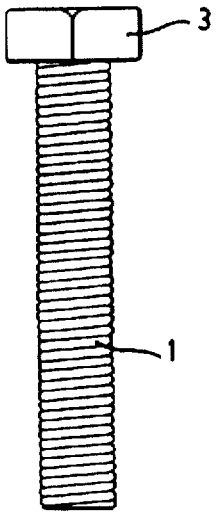
FIG. 2 is a view of the dispenser shown in FIG. 1.

The one-part dispenser shown in FIGS. 1–4 comprises a section of a draw spring 1 with turns located in close contact with one another, which section is closed at its two ends by means of a respective closure 2 and 3. The closure may consist of wood, plastic or any other, suitable material.

In the case of the embodiment shown in FIGS. 1–4, the closure is designed as a threaded plug to improve the sealing properties, and the thread has a pitch corresponding to the pitch of the turns of the spring section 1. The lower closure, designed as a plug, has the function of a nondetachable, permanent closure, and is provided for this purpose with a slot 7 for attaching a screwing tool, and it is screwed into the threaded spring section 1 with the slot 7 located on the inside, i.e., with the slot not readily accessible and especially not interfering with the outer appearance. The screwing is performed during the assembly such that the plug 2 is screwed in slightly from the outside in the usual manner, e.g., manually, and it is then screwed in by means of a screwing tool introduced from the other end through the interior of the spring section by counterclockwise rotation in the case of the usual right-hand threads.

The upper closure has, in contrast, the shape of a machine screw with a screw head 3 used as a manually actuated twist grip and with a threaded shaft 4 engaging the spring section 1, whose threads also have a pitch corresponding to that of the turns of the spring section 1. The end of the spring section 1 thus closed forms the filling opening of the dispenser. From this opening the closure 3 can be screwed out to remove it from the spring section as needed for cleaning and filling the dispenser. However, the manually actuated twist grip may also be replaced with a plug corresponding to the closure 2, which is provided in this case with a coin slot accessible from the outside instead of the tool slot. Due to the hexagonal shape of the grip part and the spiral shape of the spring, this dispenser appears to the viewer as a whole as a "screw."

Figure 5:
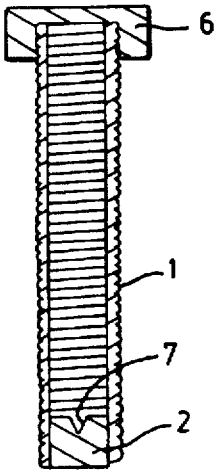
FIG. 5 is a modification of the dispenser shown in FIG. 1.
Figure 3:
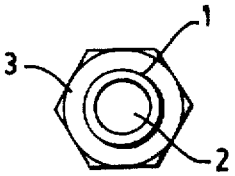
FIG. 3 is a bottom view of FIG. 2.

The screw-like closure is replaced in the modification shown in FIG. 5 with a cap 6 with a blind hole corresponding to the diameter of the spring section 1, which blind hole has internal threads corresponding to the outer dimensions of the spring section.

Figure 4:
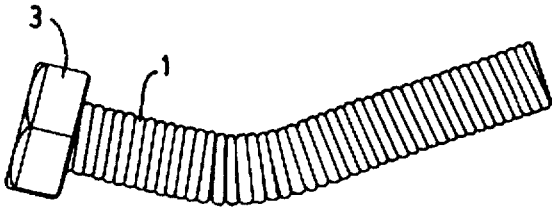
FIG. 4 is the dispenser shown in FIG. 2 in the dispersing position.
Figure 6:
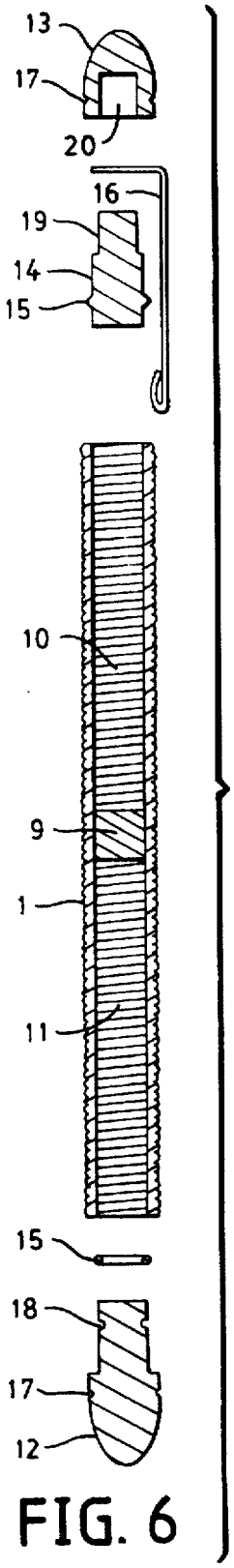
FIG. 6 is a cutaway exploded view of a one-part dispenser according to the present invention.
Figure 7:
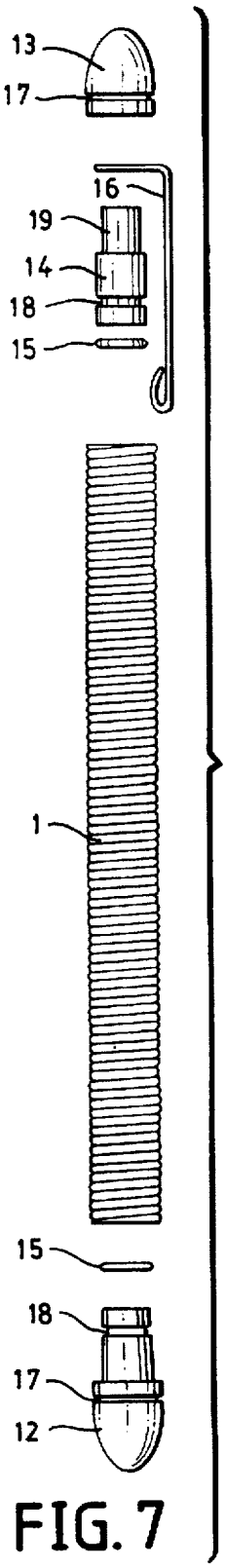
FIG. 7 is a view of the noncut parts forming the dispenser corresponding to FIG. 1.
Figure 8:
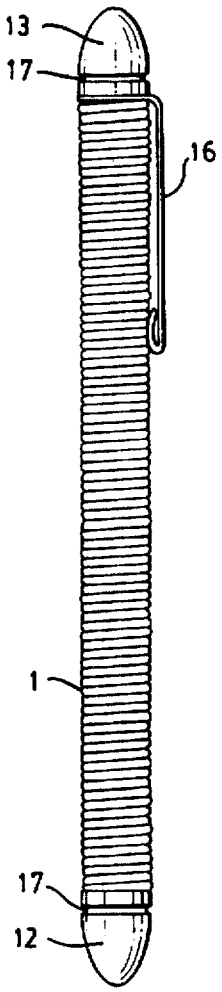
FIG. 8 is the dispenser in the state of use.
Figure 9:
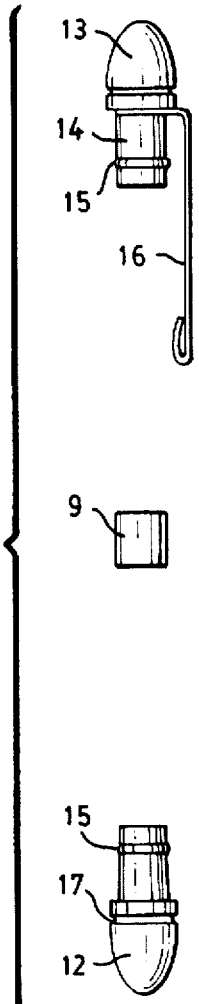
FIG. 9 is a view of the closing elements.

In the case of this embodiment, the dispenser is used to dispense only one free-flowing material, i.e., e.g., either salt or pepper, for which purpose it is bent to the shape shown in FIG. 4 between three fingers, as a result of which the spring turns open on one side and release or form slot-like passages, through which the contents trickle out at a dosage determined by the degree of bending. The dispenser according to the present invention therefore also permits the amount dispensed to be selected according to the wishes of the user in a very simple manner, contrary to all other prior-art dispensers. The dispenser is closed automatically by the restoring force of the spring after release without any additional manipulation, as a result of which an unintended opening during transportation is also ruled out because of this continuously acting restoring force.

In contrast, FIGS. 6–9, in which identical parts are designated by the same reference numbers as in FIG. 1, show a two-part dispenser comprising a correspondingly longer spring section 1, which is divided by means of an inner plug 9 into two chambers 10, 11, which are hermetically separated from one another, for two different media, i.e., e.g., pepper and salt.

Plug-type plugs are provided in this case as end closures instead of the screw plugs according to FIGS. 1–4, and these plug-type plugs comprise two parts, namely, a plug body 14 having an annular groove 18 for receiving a holding and sealing ring 15 and a cap 13. The plug body 14 has a pin part 19 and the cap 13 has a corresponding blind hole 20. The parts may be connected by simply inserting them into each other or optionally by bonding to achieve complete closure. These parts may then form either a simple closure, as, e.g., the lower plug, or, as the upper plug, a clip closure by interposing a spring clip. Unlike in the case of the embodiment shown in FIGS. 1 through 4, the dispenser presents itself in this case as a writing implement and it can also be carried at any time without any problem like a writing implement by clipping onto the pocket of a jacket or a flat partition of an attache case, and the restoring force of the spring prevents an unintended trickling of a portion of the contents. Unless one of the two plugs is provided with a clip which makes distinction possible, the plugs used to close the spring ends, especially their cap parts 13, advantageously have indicia, such as different shapes or colors to facilitate the identification of the contents of the partial sections of the dispenser, and, e.g., decorative grooves 17 having different shapes and colors may be used for this purpose.

Figure 10:
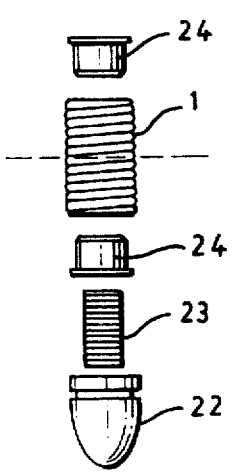
FIG. 10 is a modification of the dispenser shown in FIG. 6.

A modification of this embodiment of the dispenser is shown in FIG. 10. A mandrel is designed in this case as a threaded mandrel 23 consisting of a stud screw, which is screwed on one side into a corresponding threaded blind hole of the cap 22. The end of the spring section 1 is reinforced with a flange sleeve 24, which may consist of a plastic or another, preferably metallic material, and may be screwed into the spring section. However, it is advantageously manufactured as oversized compared with the internal diameter of the spring section, and it is pressed into the spring section. It is used to reinforce and stabilize the shape of the dispenser in its end areas, on the one hand, and as a closure 22, on the other hand. It is provided for this purpose with internal threads corresponding to the stud screw 23.

While specific embodiments of the invention have been shown and described in detail to illustrate the application of the principles of the invention, it will be understood that the invention may be embodied otherwise without departing from such principles.

What is claimed is:

1. A dispenser for a free-flowing substance, the dispenser comprising:

a draw spring including a plurality of turns positioned in contact with each other and defining a chamber for holding said substance;

first and second closure means for closing axial ends of said draw spring, one of said closure means being designed to be repetitively attached and detached from one of said axial ends of said coil spring.

2. Dispenser in accordance with claim 1, wherein:

partition means is positioned in said spring for dividing an inside of said spring into a plurality of chambers, and each of said chambers is closed on a respective axial end said coil spring by a respective said closure means, each of said closure means being designed to be repetitively attached and detached from said respective axial end of said coil spring.

3. Dispenser in accordance with claim 2, wherein:

said one closure means includes a plug body, a sealing ring and a cap defining a blind hole, said plug body defining an annular groove for receiving and holding said sealing ring, said plug body also having a mandrel corresponding to said blind hole in said cap.

4. Dispenser in accordance with claim 2, wherein:

said partition means is formed by a plug made of silicon resin.

5. Dispenser in accordance with claim 4, wherein:

said partition means includes a thread corresponding to a shape of said turns of said spring.

6. Dispenser in accordance with claim 1, wherein:

said one of said closure means is designed as a rotary plug and includes a thread with a pitch corresponding to a pitch of said turns of said spring.

7. Dispenser in accordance with claim 6, wherein:

said one of said closure means has a shape of a machine screw with a screw head as a manually actuated twist grip, said one closure means also has a threaded shaft engaging said spring.

8. Dispenser in accordance with claim 6, wherein:

said one closure has a shape of a cap with a blind hole having internal threads corresponding to a diameter of said spring.

9. Dispenser in accordance with claim 6, wherein:

said rotary plug defines a coin slot.

10. Dispenser in accordance with claim 6, wherein:

said rotary plug defines a slot for inserting a screwing tool and screwing said rotary plug into said spring, said slot being positioned on an inside of said spring when said plug is screwed into said spring.

11. Dispenser in accordance with claim 1, wherein:

said one closure means includes a plug with a plug body, a sealing ring and a cap defining a blind hole, said plug body defining an annular groove for receiving and holding said sealing ring, said plug body also having a mandrel corresponding to said blind hole in said cap.

12. Dispenser in accordance with claim 11, wherein:

said mandrel is designed as a threaded mandrel;

said spring has an end opening;

a plug-type sleeve having one end engaging said spring end opening, said plug type sleeve has internal threads corresponding to said threaded mandrel.

13. Dispenser in accordance with claim 11, wherein:

said one closure means includes a spring clip.

14. Dispenser in accordance with claim 1, wherein:

said first and second closure means have indicia means for identifying contents of said spring.

15. Dispenser in accordance with claim 14, wherein:

said indicia means comprises decorative grooves in one of shape and color.

16. A dispenser comprising:

a coil spring including a plurality of turns defining a chamber for holding a substance inside said coil spring, said plurality of turns being positioned in contact with each other to block passage of the substance from passing between said turns when said coil spring is substantially straight, said plurality of turns being formed to separate by an amount when said coil spring is bent for passage of the substance in said chamber though said turns;

first and second closure means for closing axial ends of said coil spring and blocking the substance in said chamber from passing though said axial ends of said coil spring, one of said closure means being designed to be repetitively attached and detached from said axial end of said coil spring.

17. Dispenser in accordance with claim 16, wherein:

said coil spring has a bias for biasing said plurality of turns against each other.

* * * * *